United States Patent [19]

Hahn

[11] 4,104,896

[45] Aug. 8, 1978

[54] DIAL LOCK

[76] Inventor: Hee Mok Hahn, 156-36, Songbuk-dong, Songbuk-Ku, Seoul, Rep. of Korea

[21] Appl. No.: 791,145

[22] Filed: Apr. 26, 1977

[51] Int. Cl.[2] ..... E05B 37/02

[52] U.S. Cl. ..... 70/310; 70/311; 70/318; 70/333 A

[58] Field of Search ..... 70/305, 310, 311, 318, 70/333 A

[56] References Cited

U.S. PATENT DOCUMENTS

| | | | |
|---|---|---|---|
| 269,120 | 12/1882 | Saxon | 70/310 |
| 294,290 | 2/1884 | Tregoning | 70/310 X |
| 301,646 | 7/1884 | Tregoning | 70/310 X |
| 1,158,152 | 10/1915 | Albanese | 70/310 X |
| 1,308,487 | 7/1919 | Eaton | 70/310 X |
| 1,399,886 | 12/1921 | Sarra | 70/310 |
| 1,416,855 | 5/1922 | Michalek | 70/310 |
| 1,451,036 | 4/1923 | Benham | 70/318 X |
| 1,950,503 | 3/1934 | Mahon | 70/310 |

FOREIGN PATENT DOCUMENTS

| | | | |
|---|---|---|---|
| 585,744 | 12/1924 | France | 70/310 |
| 2,007,544 | 8/1971 | Fed. Rep. of Germany | 70/310 |
| 160,128 | 2/1933 | Switzerland | 70/310 |

*Primary Examiner*—Roy D. Frazier
*Assistant Examiner*—Thomas J. Holko

[57] ABSTRACT

A dial type combination lock having a plurality of individual locking units each of which consists of a locking means and a dial means. The locking means has a pair of discs, one of which is a leading disc in which are a plurality of the holes at locations coinciding with the numbers displayed on the number carrying portion of the dial, and the other of which is the locking disc having a locking bolt receiving notch therein and a pin that is to be fit into one of the holes corresponding a designated number. The locking disc of each locking unit is connected with the leading disc thereof by the pin on the locking disc engaging in the hole in the leading disc corresponding with the designated number for the respective locking member and connecting shafts connect all the locking means to the dial means, so that during the operation of the lock, the locking bolt receiving notches in each of the locking discs are individually set in the bolt receiving position. When each of the locking member of the lock is set to the designated number, the grooves in the locking discs will be aligned so as to permit the lock to be opened.

2 Claims, 5 Drawing Figures

DIAL LOCK

This invention relates to a dial type combination lock used on safes and cabinets, etc. More particularly, this invention relates to a dial type combination lock consisting of a combination of several individual dial locking units which are operated individually and separately.

BACKGROUND OF THE INVENTION AND PRIOR ART

In the prior art, it is common to have a dial type combination lock consisting of a combination of several locking discs each of which has a groove for the locking bolt and which must be controlled separately one by one by rotation of a single dial of the lock. In other words, in ordinary safe locks having a four locking disc system, in order to open the lock, the dial must be turned four times in one direction, three times in the other direction, two times in the one direction, and one time in the other direction, respectively. When the user makes a mistake during the rotation of the dial, he must repeat the rotations of the dial from the beginning. Thus, in order to make the numbers for each of the lock discs coincide with the designated numbers during the rotation of the dial, the user must spend considerable time and may become nervous.

OBJECT AND BRIEF SUMMARY OF THE INVENTION

It is an object of the present invention to provide a dial type combination lock which overcomes these disadvantages and in which once the lock is set to an individual number of the combination, it need not be reset if a mistake is made in dialing another number of the combination.

This object is achieved according to the present invention by a dial type combination lock which comprises a plurality of individual locking units each of which consists of a locking means and a dial means. The locking means has a pair of discs, one of which is a leading disc in which are a plurality of the holes at locations coinciding with the numbers displayed on the number carrying portion of the dial, and the other of which is the locking disc having a locking bolt receiving notch therein and a pin that is to be fit into one of the holes corresponding a designated number. The locking disc of each locking unit is connected with the leading disc thereof by the pin on the locking disc engaging in the hole in the leading disc corresponding with the designated number for the respective locking member and connecting shafts connect all the locking means to the dial means, so that during the operation of the lock, the locking bolt receiving notches in each of the locking discs are individually set in the bolt receiving position. When each of the locking member of the lock is set to the designated number, the grooves in the locking discs will be aligned so as to permit the lock to be opened.

BRIEF DESCRIPTION OF THE DRAWINGS

The present invention is described in detail in the following specification taken with the accompanying drawings, in which.

DETAILED DESCRIPTION OF THE INVENTION

Figure 1:
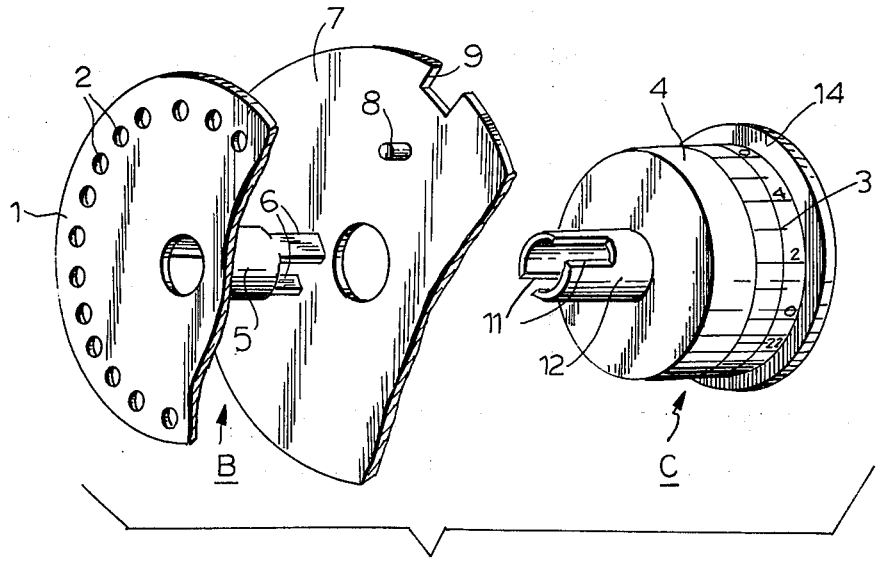
FIG. 1 is an exploded perspective view of a locking unit of the lock of the present invention.

An embodiment of the present invention consisting of four individual locking units is illustrated in the accompanying drawings. As shown in FIG. 1, each locking unit has a locking portion B and a dial portion C. Each locking portion B consists of a leading disc 1 having a plurality of holes 2 therein at locations corresponding to the series of indicia, such as numbers, displayed on a dial portion 3 of the dial 4 forming part of the dial means.

A hollow connecting shaft portion 5 is mounted at the center of the leading disc 1 and has a convex portion 6 on the free end thereof. A locking disc 7 is rotatably mounted on shaft 5 and has a pin 8 thereon that is engaged in the hole 2 corresponding to the number of the combination for the respective locking unit. The edge of locking disc 7 has a notch 9 therein for receiving a locking bolt (not shown in the drawings). The connecting shaft 5 which extends through the central hole 10 in the locking disc 7 is telescopically engaged with a hollow shaft 12 on the dial unit C by the engagement of the convex portion 6 with a corresponding concave portion 11 in the shaft 12. The connecting shaft 5 of the locking means B and the connecting shaft 12 of the dial means C are rotatably mounted on a central supporting shaft 13. Because the pin 8 on the locking disc 7 is engaged in one of the holes 2 in the leading disc 1, when the dial means C is rotated, the locking means B consisting of the leading disc 1 and the locking disc 7 is also rotated as a single body. The pin 8 is engaged in the hole 2 corresponding with the designated number of the combination such that when the designated number on the dial 4 is aligned with an index 20, the notch 9 is positioned to receive the locking bolt.

Each of the dial means C consists of a cup-shaped dial 4 having the cylindrical number carrying dial portion 3 having thereon the numbers corresponding to the holes 2 in the leading disc 1, an end portion 14 on the free end of the dial portion 3, and the connecting shaft 12 projecting from the base 3*a* and having the concave portion 11 in the end thereof.

A plurality of locking units, for example four locking units, are mounted on central shaft 13, the pairs of engaged connecting shafts 5 and 12, 5' and 12',5'' and 12'', and 5''' and 12''' being successively concentric, with the innermost pair of shafts 5 and 12 being the longest, the next outer shafts 5' and 12' being shorter and the successive concentric shaft pairs in the radially reward direction being successively shorter. On the other hand, the diameters of the cup shaped dial units 4, 4', 4'' and 4''' are successively larger and nest in each other.

Thus the lock of the present invention has the four locking units generally concentric with one another, and the four locking units are supported collectively on the central supporting shaft 13.

When the lock of the present invention is mounted on a door 18 or the corresponding element to be locked, the locking means B comprising the leading disc and the locking disc of each unit is located on the inside of the door, while the dial means C having the dial portion 3 is located on the outside of the door. A central supporting plate 15 is mounted on the end of the central supporting shaft 13 on the outside of the door and spaced from the base of the cup shaped innermost dial means 4. An outer cover 16 is mounted on the innermost nested dial means C. A protecting case 17 is positioned around the outermost dial means 4, being fastened to the door 18 and carries the index 20 thereon. Supporting members 19 are mounted on the inner side of the door 18 so that the locking means B can rotate smoothly.

Because the connecting shafts 5 and 12 are telescopically engaged by the convex portion 6 and the concave portion 11, the dial means C can be drawn out from within the supporting member 19 during operation. However, the amount the dial means can be drawn out is restricted by the central supporting plate 15, and they cannot be separated from the protecting case 19 and are always maintained in suitable positions for rotation of the dial portions.

Figure 2:
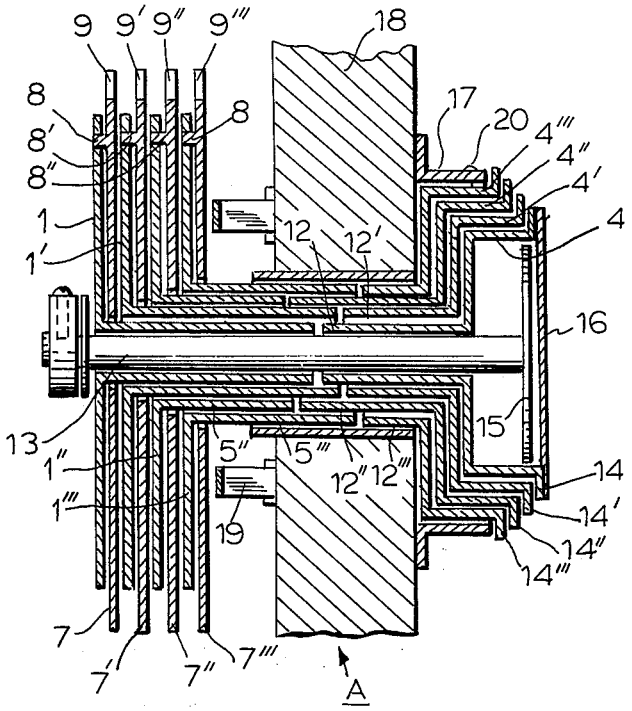
FIG. 2 is an axial cross sectional view of the lock of the invention.
Figure 3A:
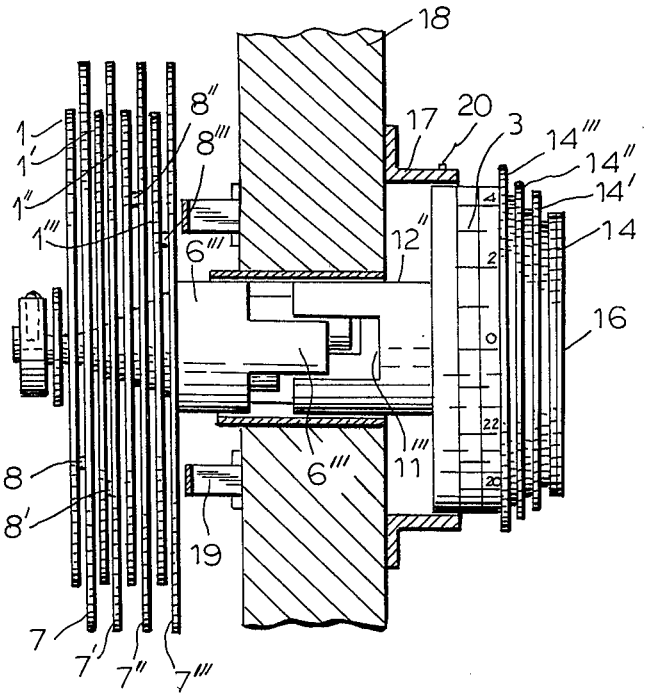
FIGS. 3*a* and 3*b* are sectional views of the lock of the invention showing the parts in different operational positions; state.
Figure 3B:
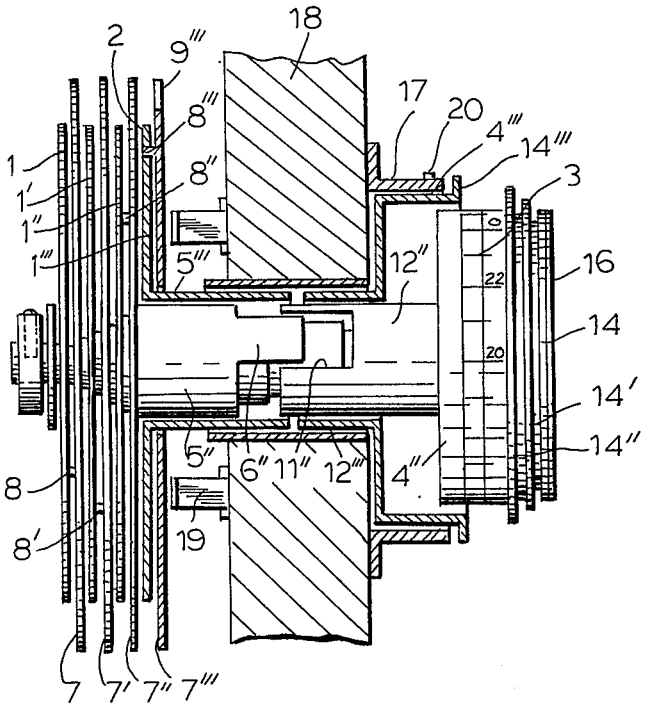
Figure 4:
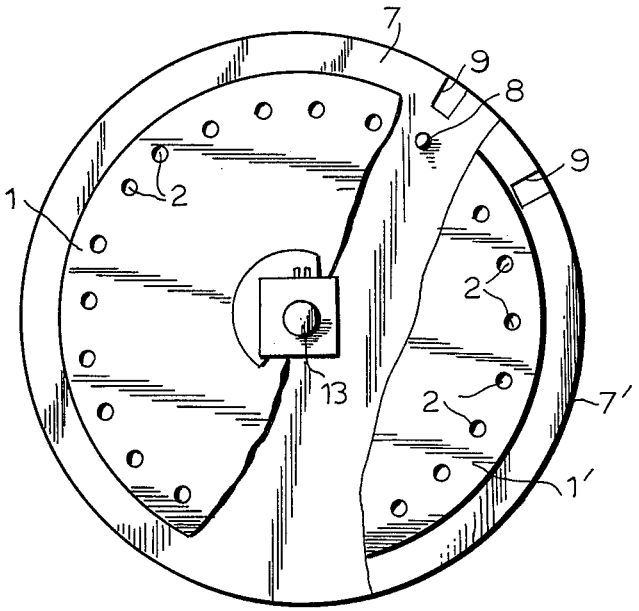
FIG. 4 is an elevational view, partly broken away, of a locking unit of the lock of the invention.

When the dial type combination lock of this invention is operated, all the dial means must be drawn out of the protecting case 17 until the dial portion 3 of the outermost dial means 4''' is exposed (see FIG. 3*a*). The dial means 4''' is rotated in either direction until the designated combination number on the dial portion 3 is aligned with the index 20. Since the convex portion 6''' of the connecting shaft 5''' and the concave portion 11''' of the connecting shaft 12''' are engaged and thus rotated together, the locking disc 7''' having the groove 9''' therein is also rotated to the position where the groove 9''' is located in alignment with the locking bolt. The dial means 4''' is then moved into the protecting case 17 (see FIG. 3*b*) telescoping shafts 5''' and 12''', and thus exposing the dial portion of the next inner dial means 4''. By repeating the same operation one dial means at a time, all the groves 9'', 9' and 9 will be aligned with groove 9''' to permit opening of the lock (see FIG. 2).

If the user of the lock of this invention desires to change the designated numbers of the combination, the supporting members 19 on the inside of the door must be removed and the innermost dial means 4 must be rotated until the corresponding designated number of the existing combination reaches the index 20. When the groove 9 is located in the proper position, then the locking disc 7 is pushed toward the door 18 so that the pin 8 is removed from the hole 2. Next, the dial means 4 is rotated together with the leading disc 1 until the new designated number reaches the index 20. Then the locking disc 7 is moved toward the leading disc 1 until the pin 8 on the locking disc 7 is fixed in the new hole 2 in the leading disc 1. The groove 9 in the locking disc 7 will still be located in the position to permit opening of the lock, and this will coincide with the new designated number. By repeating the same steps for each of the locking units, the combination of the lock can be changed. After the change of the designated number for each of the locking units has been completed, the supporting members 19 are again mounted on the wall of the door 18 to support the smooth rotation of the locking units.

It will thus be seen that the dial lock of this invention can be easily operated by bringing the designated numbers for each locking unit into coincidence with the index 20 without repeatedly rotating the dial means back and forth in opposite directions as in the conventional dial type combination locks. Moreover, a mistake in setting any one of the dial means to the designated number does not require resetting any of the other dial means. One can change the designated combination easily. Thus it is clear that the present dial type combination lock is convenient to use and secure.

Because each locking disc is directly rotated by each dial, it is possible for the user to optionally select the designated numbers to open the lock and change the lock to operate on these numbers by selectively changing the connecting position between the locking disc and the leading disc.

What is claimed is:

1. A dial type combination lock comprising a plurality of locking units, each locking unit having a locking means comprising a leading disc having a plurality of holes around the outer edge thereof corresponding to a series of indicia and a connecting shaft projecting from the center thereof, and a locking disc rotatably mounted on said connecting shaft and having a pin adjacent the periphery thereof and engaged in one of the holes in said leading disc and a bolt receiving notch in the outer periphery thereof, and each locking unit having a dial means comprising a cup-shaped dial having an upstanding wall and base, the wall defining an indicia carrying portion on the radial outer surface thereof and a further connecting shaft projecting from the base thereof and telescopically coupled with said connecting shaft on said leading disc so that the dial may move from an inner to an outer position relative to the locking means, an innermost one of said plurality of locking units being mounted on a central supporting shaft and successive locking units having the connecting shafts successively larger in diameter and concentric with each other, said connecting shafts being successively shorter the larger the diameter thereof, the walls of the cup-shaped dials on the successive locking units being nested in each other and the successive locking discs and leading discs of the locking units being side by side, a protecting case around the wall of the dial of the outermost dial means and having an index thereon, whereby the dials must be drawn out from their inner position to their outer position to expose the indicia carrying portion thereof, and at least one supporting member engaged with the locking disc on the outermost locking unit to prevent movement of the locking disc, said protecting case being adapted to be mounted on one side of a member to be locked and the supporting member being adapted to be mounted on the other side of the member to be locked.

2. A dial type combination lock as claimed in claim 1 in which said central supporting shaft has a supporting plate on the end thereof within the innermost cup shaped dial and spaced from the base of said dial when said dial is in its inner position closest to said locking means of the innermost locking unit.

* * * * *